US011035287B2

(12) United States Patent
Kobayashi et al.

(10) Patent No.: US 11,035,287 B2
(45) Date of Patent: Jun. 15, 2021

(54) ENGINE COOLING STRUCTURE

(71) Applicant: TOYOTA JIDOSHA KABUSHIKI KAISHA, Toyota (JP)

(72) Inventors: Tsubasa Kobayashi, Toyota (JP); Yuji Iwase, Anjo (JP); Hiroyuki Okuno, Toyota (JP); Tadasu Tomohiro, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 115 days.

(21) Appl. No.: 16/124,868

(22) Filed: Sep. 7, 2018

(65) Prior Publication Data

US 2019/0112967 A1 Apr. 18, 2019

(30) Foreign Application Priority Data

Oct. 13, 2017 (JP) ..... JP2017-199632

(51) Int. Cl.

| | |
|---|---|
| ***F01P 7/14*** | (2006.01) |
| ***F01P 11/04*** | (2006.01) |
| ***F01P 3/12*** | (2006.01) |
| *F01P 3/00* | (2006.01) |

(52) U.S. Cl.

CPC ..... *F01P 11/04* (2013.01); *F01P 3/12* (2013.01); *F01P 7/14* (2013.01); *F01P 2003/001* (2013.01)

(58) Field of Classification Search

CPC ..... F16L 3/237; F01P 11/04
USPC ..... 123/41.1
See application file for complete search history.

(56) References Cited

U.S. PATENT DOCUMENTS 4,519,637 A * 5/1985 Folkers ..... F16L 55/16 285/113
4,840,223 A * 6/1989 Lee ..... F01P 11/06 134/111
4,923,226 A * 5/1990 Bartholomew ..... F16L 33/225 285/242
5,181,536 A * 1/1993 Argyle ..... G01N 17/00 116/206

(Continued)

FOREIGN PATENT DOCUMENTS

CN 101058303 A 10/2007
CN 201803040 U 4/2011

(Continued)

*Primary Examiner* — Long T Tran
*Assistant Examiner* — James J Kim
(74) *Attorney, Agent, or Firm* — Oliff PLC

(57) ABSTRACT

Provided is an engine cooling structure for an engine where the engine is cooled by a cooling fluid supplied from a radiator, and the cooling fluid discharged from the engine is cooled by the radiator. The cooling structure includes: an inlet hose having one end coupled to the engine, and having the other end coupled to the radiator, the inlet hose including two or more hose members, and a connecting pipe configured to connect the two or more hose members, to each other; and a clamp including a pipe-side connection portion connected to the connecting pipe, and an engine-side connection portion directly or indirectly connected to the engine. The clamp has a gap between the clamp and the connecting pipe, and the gap functions as a transmission suppressing portion which suppresses transmission of vibrations from the engine-side connection portion to the connecting pipe.

2 Claims, 4 Drawing Sheets

(56) References Cited

U.S. PATENT DOCUMENTS

| | | | | |
|---|---|---|---|---|
| 6,003,906 | A * | 12/1999 | Fogarty | A61M 39/12 285/242 |
| 6,308,992 | B1 * | 10/2001 | Mitsui | F16L 33/30 285/133.11 |
| 8,312,950 | B2 * | 11/2012 | Contardi | B62D 25/084 180/68.4 |
| 9,273,811 | B1 * | 3/2016 | Webber | F16L 33/2071 |
| 2004/0183301 | A1 * | 9/2004 | Yoshida | B29C 66/322 285/305 |
| 2005/0167980 | A1 * | 8/2005 | Bauer | F16L 37/1205 285/308 |
| 2007/0240923 | A1 * | 10/2007 | Matsushima | F16L 55/035 180/68.4 |
| 2013/0001373 | A1 | 1/2013 | Ogawa | |
| 2018/0016966 | A1 * | 1/2018 | Gidla | F02M 35/10327 |

FOREIGN PATENT DOCUMENTS

| | | | |
|---|---|---|---|
| CN | 102770670 | A | 11/2012 |
| JP | 2000-186555 | A | 7/2000 |
| JP | 2014-206115 | A | 10/2014 |
| JP | 2015-021414 | A | 2/2015 |
| JP | 2017-115643 | A | 6/2017 |

* cited by examiner

ENGINE COOLING STRUCTURE

CROSS REFERENCE TO RELATED APPLICATION

The entire disclosure of Japanese Patent Application No. 2017-199632 filed on Oct. 13, 2017 including the specification, claims, drawings, and abstract is incorporated herein by reference in its entirety.

TECHNICAL FIELD

This specification discloses an engine cooling structure where an engine is cooled by a cooling fluid supplied from a radiator, and the cooling fluid discharged from the engine is cooled by the radiator.

BACKGROUND

An engine cooling structure is widely known where an engine is cooled by a cooling fluid supplied from a radiator, and the cooling fluid discharged from the engine is cooled by the radiator. In such a cooling structure, radiator hoses through which the cooling fluid flows extend between the radiator and the engine.

Such radiator hoses have a long length compared to a distance between the radiator and the engine. Accordingly, the radiator hose is liable to move significantly swinging at an intermediate portion of the radiator hose which is separated at a distance from fixed ends connected to the engine and the radiator. When the radiator hose swings significantly at the intermediate portion, there may be a case where the radiator hose interferes with other members so that the other members and/or the radiator hose deteriorate or are damaged.

In view of the above, fixing of the intermediate portion of the radiator hose to the engine by means of a fixing member is considered. With such a configuration, significant swinging of the intermediate portion of the radiator hose can be suppressed.

Conventionally, the intermediate portion of the radiator hose which is fixed to the engine is formed of a hose member having an outer surface made of ethylene-propylene rubber (EPDM) or the like. In this case, the hose member per se has vibration absorbing capability to some extent. Accordingly, even when the engine vibrates, the hose member fixed to the engine resists vibrating so that there is a low possibility of the hose member being damaged due to vibrations.

However, due to the arrangement relationship between the radiator hose and other members, there may be a case where a portion of the radiator hose which is fixed to the engine by means of the fixing member is not the hose member made of EPDM or the like, but is a connecting pipe connected to the hose member. Usually, such a connecting pipe is made of a resin or the like so that the connecting pipe is hard, thus having poor vibration absorbing characteristics in many cases. When such a connecting pipe is fixed to the engine by means of the fixing member, vibrations of the engine are transmitted to the connecting pipe through the fixing member so that the connecting pipe per se is liable to vibrate. Further, due to such vibrations, there is a possibility of loosening of the connection between the connecting pipe and the hose member, and of deterioration or damage of the connecting pipe per se.

JP 2017-115643 A (Patent literature 1) discloses a technique where pawls are formed on a peripheral edge of an intake duct through which air is introduced into an engine, and the pawls are fitted on a pin, projecting from a cylinder head cover, by way of a grommet made of a rubber material. According to such a technique, vibrations from a vehicle or the engine resist being transmitted to the intake duct. However, Patent literature 1 only relates to a mounting structure for an intake duct, and Patent literature 1 does not disclose a mounting structure for a radiator hose at all.

That is, conventionally, there has been no technique which can prevent a problem of a connecting pipe, caused by vibrations of an engine, in fixing a connecting pipe provided to a radiator hose to the engine.

Accordingly, this specification discloses an engine cooling structure which can fix a connecting pipe provided on a radiator hose to an engine while protecting the connecting pipe from vibrations of the engine.

SUMMARY OF THE INVENTION

An engine cooling structure disclosed in this specification is an engine cooling structure where an engine is cooled by a cooling fluid supplied from a radiator, and the cooling fluid discharged from the engine is cooled by the radiator. The engine cooling structure includes: a radiator hose having one end coupled to the engine, and having the other end coupled to the radiator, the radiator hose including two or more hose members and a connecting pipe configured to connect the two or more hose members to each other; and a clamp including a pipe-side connection portion connected to the connecting pipe, and an engine-side connection portion directly or indirectly connected to the engine. The clamp is provided with a transmission suppressing portion which suppresses transmission of vibrations from the engine-side connection portion to the connecting pipe.

With such a configuration, although the connecting pipe is fixed to the engine, the transmission suppressing portion is present so that vibrations of the engine transmitted to the engine-side connection portion resist being transmitted to the connecting pipe. As a result, it is possible to fix the connecting pipe to the engine while protecting the connecting pipe from vibrations of the engine.

The transmission suppressing portion may be formed of a gap provided between the pipe-side connection portion and the connecting pipe.

The transmission suppressing portion is formed of a gap so that it is possible to fix the connecting pipe to the engine while protecting the connecting pipe from vibrations of the engine with a simple structure.

In this case, the pipe-side connection portion may include an annular body 86 disposed on an outer periphery of the connecting pipe 38 with the gap 84, which functions as the transmission suppressing portion 82, interposed between the annular body 86 and the outer periphery of the connecting pipe 38.

With such a configuration, the connecting pipe is movable in the circumferential direction, in the radial direction, and in the axial direction of the connecting pipe with respect to the pipe-side connection portion. As a result, vibrations in various directions resist being transmitted to the connecting pipe so that it is possible to more reliably protect the connecting pipe from vibrations of the engine.

Further, in this case, the connecting pipe may include a main tube, and a columnar portion which stands out from a peripheral surface of the main tube, and the pipe-side connection portion may have: the annular body disposed on the outer periphery of the main tube with the gap, which functions as the transmission suppressing portion, interposed between the annular body and the outer periphery of the main tube; and a center hole which is formed in a peripheral surface of the annular body, and into which the columnar portion is inserted.

With such a configuration, due to a contact relationship between the columnar portion and the center hole, an amount of movement of the connecting pipe in the circumferential direction and in the axial direction with respect to the pipe-side connection portion is limited to some extent. Accordingly, excessive movement of the connecting pipe can be restricted.

The transmission suppressing portion may be formed of a buffer member provided between the pipe-side connection portion and the connecting pipe.

When such a configuration is adopted, collision energy between the clamp and the connecting pipe is absorbed by the buffer member and hence, deterioration or damage of the clamp can be more reliably prevented.

According to the engine cooling structure disclosed in this specification, although the connecting pipe is fixed to the engine, the transmission suppressing portion is present so that vibrations of the engine transmitted to the engine-side connection portion resist being transmitted to the connecting pipe. As a result, it is possible to fix the connecting pipe to the engine while protecting the connecting pipe from vibrations of the engine.

BRIEF DESCRIPTION OF DRAWINGS

Embodiments of the present disclosure will be described based on the following figures, wherein.

DESCRIPTION OF EMBODIMENTS

Figure 1:
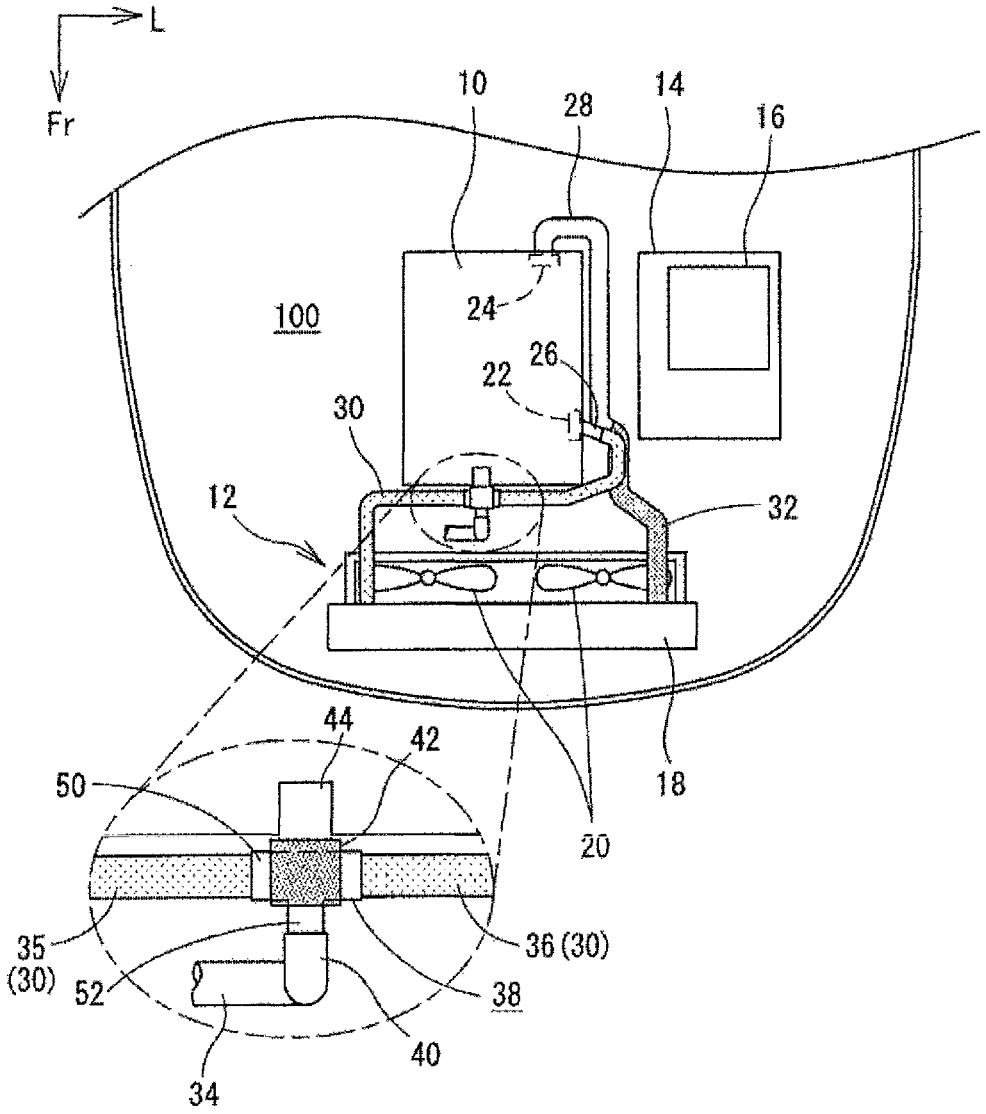
FIG. 1 is a schematic plan view of a front portion of a vehicle.

Hereinafter, an engine cooling structure for an engine 10 is described with reference to drawings. FIG. 1 is a schematic plan view of a front portion of a vehicle. In FIG. 1, to easily distinguish between an inlet pipe 26 and an outlet pipe 28, the outlet pipe 28 is illustrated with a larger diameter than the inlet pipe 26. However, both pipes 26, 28 have the same diameter in the actual structure. In the same manner, an outlet hose 32 is also illustrated with a larger diameter than an inlet hose 30. However, both hoses 30, 32 have the same diameter in the actual structure. Further, in FIG. 1, light shading is applied to the inlet hose 30, and dark shading is applied to the outlet hose 32.

This vehicle is a hybrid vehicle having the engine 10 and a motor as a power source for allowing the vehicle to travel. However, the technique disclosed in this specification is not limited to a hybrid vehicle, but may be also applicable to a vehicle having only the engine 10 as a power source.

As shown in FIG. 1, a space referred to as an engine compartment 100 is formed in the front portion of the vehicle. The engine 10 and a motor unit 14 are disposed in the vicinity of the center of the engine compartment 100. The engine 10 is a water-cooled engine, and a water jacket (not shown in the drawing) forming a flow passage for a cooling fluid is provided in the engine 10. The cooling fluid, for example, antifreeze, flows through the water jacket so that the engine 10 is cooled. One end of the flow passage formed of the water jacket forms an introduction port 22 for the cooling fluid, and the other end of the flow passage forms a discharge port 24 for the cooling fluid. The inlet pipe 26 and the outlet pipe 28 extend from an outer surface of the engine 10. The inlet pipe 26 communicates with the introduction port 22, and the outlet pipe 28 communicates with the discharge port 24.

The motor unit 14 is disposed on the left side of the engine 10. The motor unit 14 is configured such that a motor, a generator, a transmission and the like are formed into a unit. The motor generates power for traveling. The generator generates electric power using surplus power of the engine 10. A power control unit 16 is also disposed in the vicinity of the motor unit 14 (for example, above the motor unit 14). An inverter, a transformer and the like are provided in the power control unit 16. The inverter controls the drive of the motor and the generator. The transformer transforms input/output electric power.

A radiator 12 is disposed forward of the engine 10 and the motor unit 14. The radiator 12 includes a radiator core 18 through which the cooling fluid discharged from the engine 10 flows. The cooling fluid is used for cooling the engine 10 so that the temperature of the cooling fluid is increased. Such a cooling fluid is cooled in the process of flowing through a flow passage formed in the radiator core 18. The cooling fluid which is cooled is fed to the engine 10 again, and is used for cooling the engine 10.

Radiator fans 20 which are electric fans are disposed rearward of the radiator core 18. The radiator fans 20 are driven so as to feed air toward a rear portion of the vehicle. With such an operation, an amount of air flow which passes through the radiator core 18 is increased so that heat radiation from the cooling fluid is accelerated. A reservoir tank which stores the cooling fluid therein, a pump for pumping the cooling fluid and the like are also provided in the radiator core 18. However, all of these members are well-known techniques and so detailed description of these members is omitted here.

The inlet hose 30 and the outlet hose 32 extend between the radiator core 18 and the engine 10 as radiator hoses through which a cooling fluid flows. One end of the inlet hose 30 is coupled to the inlet pipe 26, and one end of the outlet hose 32 is coupled to the outlet pipe 28. Further, the other end of the inlet hose 30 is coupled to a right end of the radiator core 18, and the other end of the outlet hose 32 is coupled to a left end of the radiator core 18. A cooling fluid cooled by the radiator core 18 is supplied to the water jacket for the engine 10 through the inlet hose 30 and the inlet pipe 26. The cooling fluid supplied to the water jacket performs heat exchange with the engine 10, thus cooling the engine 10. The cooling fluid that has increased in temperature due to such heat exchange is returned to the radiator core 18 through the outlet pipe 28 and the outlet hose 32. The cooling fluid returned to the radiator core 18 is cooled by air in the process of flowing through the radiator core 18, and the cooling fluid is supplied to the engine 10 again.

The inlet hose 30 is roughly divided into an upstream hose 35 extending from the radiator 12, a downstream hose 36 coupled to the inlet pipe 26, and a connecting pipe 38 which connects the upstream hose 35 and the downstream hose 36 to each other. The connecting pipe 38 is a three-way pipe, as will be described later. Not only the upstream hose 35 and the downstream hose 36 but also a cooler hose 34 extending to an oil cooler (not shown in the drawing) are connected to the connecting pipe 38. The upstream hose 35, the downstream hose 36 and the cooler hose 34 are not particularly limited provided that the hoses have sufficient heat resistance and pressure resistance. For example, each hose may be formed using a hose where a reinforcing fiber layer is embedded in a tube body made of a rubber material such as ethylene-propylene rubber (EPDM).

Figure 2:
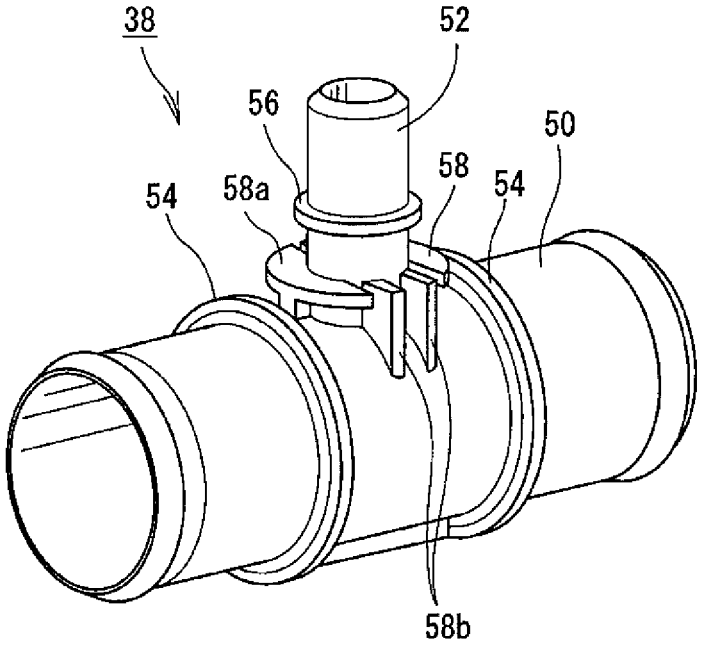
FIG. 2 is a perspective view of a connecting pipe.
Figure 3:
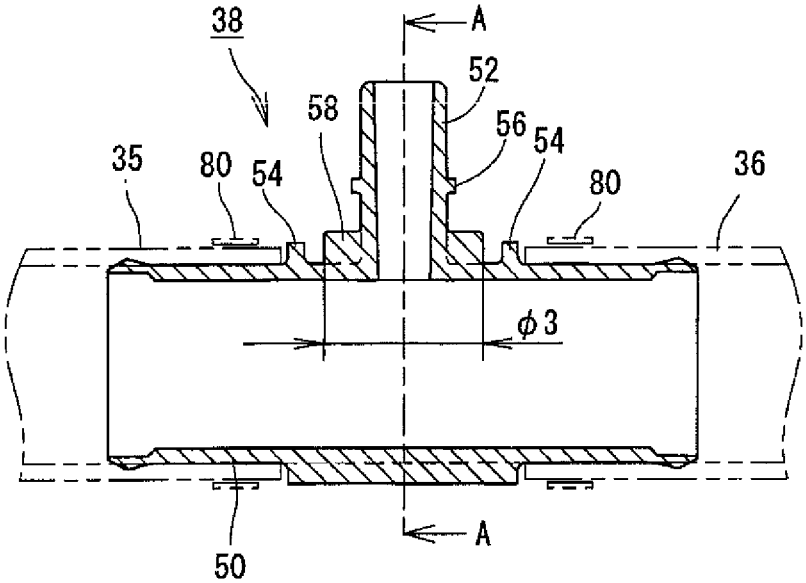
FIG. 3 is a cross-sectional view of the connecting pipe.
Figure 4:
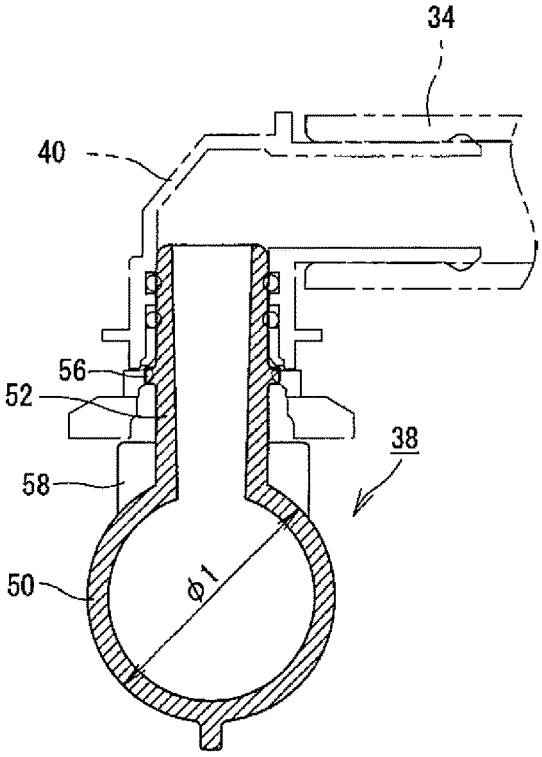
FIG. 4 is a cross-sectional view taken along line A-A in FIG. 3.

The connecting pipe 38 is a hard pipe member made of a resin or the like. FIG. 2 is a perspective view of the connecting pipe 38. FIG. 3 is a transverse cross-sectional view of the connecting pipe 38, and FIG. 4 is a cross-sectional view taken along line A-A in FIG. 3. As shown in FIG. 3 and the like, the connecting pipe 38 has a three-way structure which includes a main tube 50 to which the upstream hose 35 and the downstream hose 36 are coupled, and a sub tube 52 which projects from a peripheral surface of the main tube 50. The cooler hose 34 is connected to the sub tube 52 by means of a quick joint 40 (see FIG. 4).

Referring to FIG. 1 again, the connecting pipe 38 is fixed to the engine 10 by way of a clamp 42 and a bracket 44. In other words, the inlet hose 30 is fixed to the engine 10 at an intermediate position thereof. The inlet hose 30 is fixed at the intermediate position thereof as described above so as to prevent swinging of the inlet hose 30 at the intermediate position. That is, the inlet hose 30 has a long length, and accordingly, when the inlet hose 30 is not fixed at a position separated from fixed ends connected to the engine 10 and the radiator 12 (at the intermediate position), the inlet hose 30 is liable to swing. When the inlet hose 30 swings significantly at the intermediate portion, there may be a case where the inlet hose 30 interferes with other members so that the other members and/or the inlet hose 30 deteriorate or are damaged. In view of the above, the connecting pipe 38 is fixed to the engine 10 so as to suppress significant swinging at the intermediate position.

In this embodiment, the bracket 44 is a metal fitting directly or indirectly fixed to the engine 10, and the bracket 44 is substantially stationary with respect to the engine 10. The clamp 42 includes an annular body which is mounted on the bracket 44, and is mounted on an outer periphery of the connecting pipe 38. As will be described later, the clamp 42 is mounted on the bracket 44 in a substantially stationary manner. On the other hand, the clamp 42 is mounted on the connecting pipe 38 with slight play. The play (gap) is provided between the clamp 42 and the connecting pipe 38 as described above so as to suppress transmission of vibrations of the engine 10 to the connecting pipe 38.

That is, the engine 10 vibrates significantly with the drive of the engine 10 as a matter of course. The bracket 44 fixed to the engine 10 and the clamp 42 also vibrate significantly with the drive of the engine 10. It is assumed that the connecting pipe 38 is connected to the clamp 42 in a state where the connecting pipe 38 is not movable relative to the clamp 42 at this point of operation. In this case, as described above, the connecting pipe 38 is hard, thus exhibiting poor vibration absorbing characteristics, and hence the connecting pipe 38 also vibrates significantly with the drive of the engine 10. When the connecting pipe 38 vibrates significantly, there is a possibility that the connection between the connecting pipe 38 and the hoses 34, 35, 36 will be loosened, and that a stress will act on the connecting pipe 38 thus causing deterioration or damage of the connecting pipe 38.

In view of the above, in the cooling structure disclosed in this specification, slight "play" is provided between the clamp 42 and the connecting pipe 38 as a transmission suppressing portion which suppresses transmission of vibrations. Configurations of the connecting pipe 38 and the clamp 42 are described hereinafter.

First, the structure of the connecting pipe 38 is described. As described above and as shown in FIG. 2 to FIG. 4, the connecting pipe 38 is a three-way pipe which includes the main tube 50 having both ends open, and the sub tube 52 standing out from the peripheral surface of the main tube 50. Both ends of the main tube 50 are inserted into the upstream hose 35 and the downstream hose 36 so that the upstream hose 35 and the downstream hose 36 are fitted on outer peripheries of both ends of the main tube 50. The upstream hose 35 and the downstream hose 36 which are fitted on both ends of the main tube 50 are firmly fixed on the main tube 50 by means of known hose bands 80. Further, a pair of protruding portions 54 are formed on the main tube 50 at portions disposed on both sides of the sub tube 52 in the axial direction of the main tube 50. The protruding portions 54 project outward in the radial direction so as to allow the main tube 50 to locally have a large diameter. The upstream hose 35 and the downstream hose 36 are fitted on the main tube 50 in the vicinity of these protruding portions 54.

The sub tube 52 has a smaller diameter than the main tube 50, and stands out from the peripheral surface of the main tube 50 at the center in the axial direction of the main tube 50. An annular rib 56 is formed at an intermediate portion of the sub tube 52, and the annular rib 56 projects outward so as to allow the sub tube 52 to locally have a large diameter. A portion of the quick joint 40 engages with the annular rib 56. That is, the upstream hose 35 and the downstream hose 36 are coupled to the main tube 50 using the hose bands 80. On the other hand, the cooler hose 34 is coupled to the sub tube 52 using the quick joint 40. The reason for adopting such a configuration is that there is not sufficient space for performing a coupling operation of the cooler hose 34.

That is, in this embodiment, the radiator 12 is installed onto a vehicle and assembled on the engine 10 in a state where the upstream hose 35, the connecting pipe 38, and the downstream hose 36 are assembled on the radiator 12. The connecting pipe 38 and the cooler hose 34 are connected to each other after the radiator 12 and the like are installed onto the vehicle. Accordingly, in performing a connecting operation between the connecting pipe 38 and the cooler hose 34, it is difficult to ensure sufficient space, and so the connection of the connecting pipe 38 and the cooler hose 34 using a hose band is difficult. In view of the above, in this embodiment, the quick joint 40 is connected to the cooler hose 34 in advance (see FIG. 4), and the quick joint 40 is connected to the sub tube 52 of the connecting pipe 38. With such a configuration, the sub tube 52 and the cooler hose 34 can be easily connected to each other even with a narrow operation space. The configuration of the quick joint 40 is not particularly limited provided that the quick joint 40 can be connected to the sub tube 52 in one operation in a liquid-tight manner. Accordingly, a known joint configuration can be adopted.

A columnar portion 58 is formed at a proximal end of the sub tube 52. The columnar portion 58 is connected to the peripheral surface of main tube 50 and to a peripheral surface of the sub tube 52, and the columnar portion 58 has a larger diameter than the sub tube 52. Several notches are formed in the columnar portion 58 so that the columnar portion 58 is divided into semicircular portions 58*a* and rectangular portions 58*b*. The columnar portion 58 is inserted into a center hole 68 of the clamp 42 described later.

Figure 5:
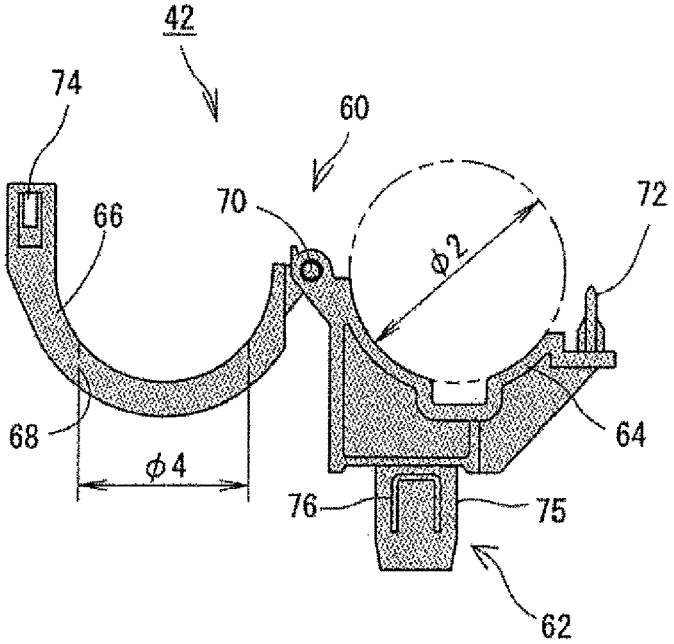
FIG. 5 is a view of a clamp in an open state as viewed in an axial direction.
Figure 6:
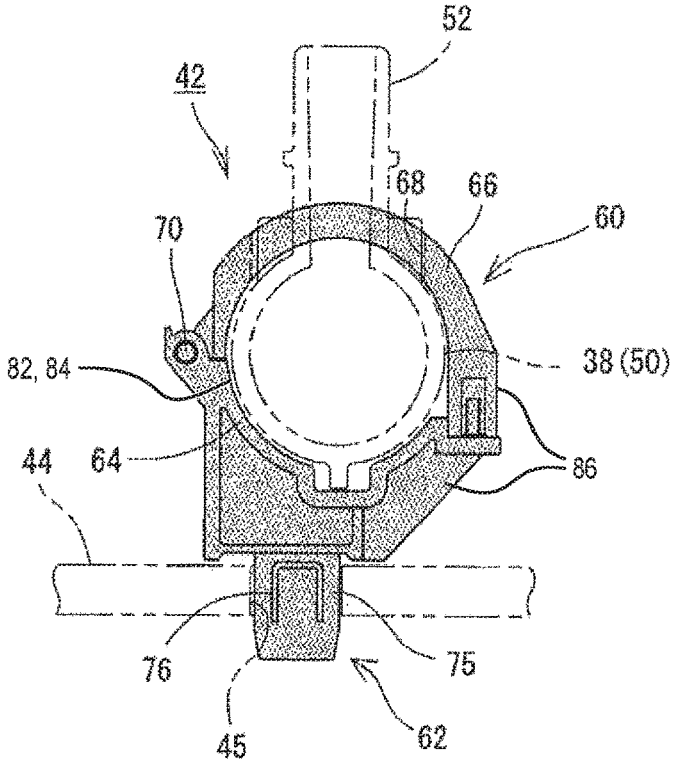
FIG. 6 is a view of the clamp in a closed state as viewed in the axial direction.
Figure 7:
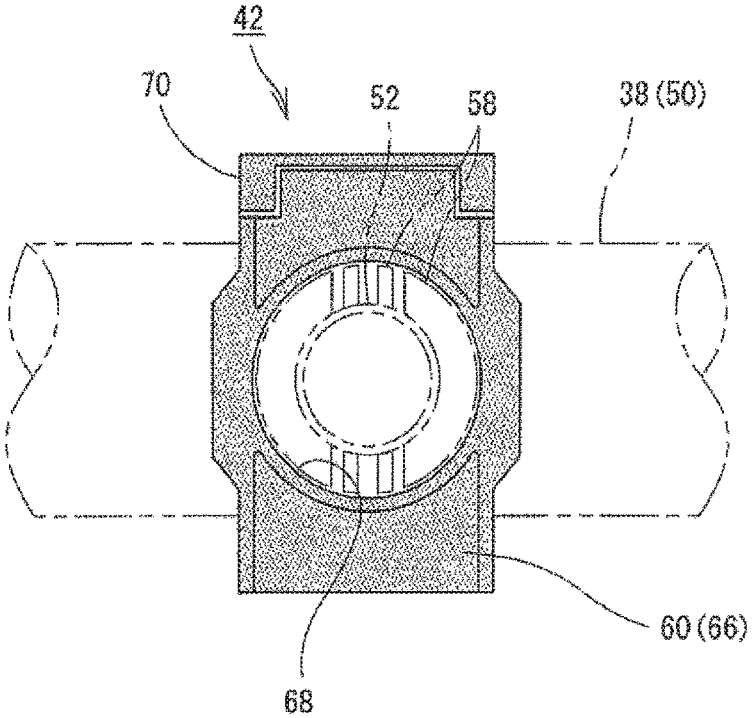
FIG. 7 is a plan view of the clamp.

Next, the configuration of the clamp 42 is described with reference to FIG. 5 to FIG. 7. FIG. 5 is a view of the clamp 42 in an open state as viewed in the axial direction, and FIG.

6 is a view of the clamp 42 in a closed state as viewed in the axial direction. Further, FIG. 7 is a plan view of the clamp 42. The clamp 42 is roughly divided into a pipe-side connection portion 60 connected to the connecting pipe 38 and an engine-side connection portion 62 connected to the bracket 44. As shown in FIG. 5, the pipe-side connection portion 60 is configured such that first and second clamp pieces 64, 66 having a substantially semicircular shape are connected to each other by means of a hinge portion 70 in such a manner as to be openable and closable. The hinge portion 70 is formed at one end of the first clamp piece 64 in the circumferential direction, and an engaging pin 72 which engages with the second clamp piece 66 is formed at the other end of the first clamp piece 64. An engaging hole 74 which engages with the engaging pin 72 is thinned at one end of the second clamp piece 66, and the hinge portion 70 is formed at the other end of the second clamp piece 66. The center hole 68 is formed in the second clamp piece 66. The center hole 68 is a circular through hole which allows the sub tube 52 and the columnar portion 58 to pass therethrough.

In connecting the clamp 42 to the connecting pipe 38, it is sufficient to perform the following operations. That is, in a state where the sub tube 52 and the columnar portion 58 are made to pass through the center hole 68, the first clamp piece 64 is rotated to the second clamp piece 66 side so as to cause the engaging pin 72 of the first clamp piece 64 to be engaged with the engaging hole 74 of the second clamp piece 66. At this point of operation, the pipe-side connection portion 60 formed of the first clamp piece 64 and the second clamp piece 66 forms an annular body which covers an outer periphery of the main tube 50 of the connecting pipe 38. In this embodiment, an inner diameter Φ2 of the pipe-side connection portion 60 (see FIG. 5) is slightly larger than an outer diameter Φ1 of the main tube 50 (see FIG. 4). In other words, the pipe-side connection portion 60 and the main tube 50 have the loose-fitting relationship so that a slight gap is present between an inner surface of the pipe-side connection portion 60 (annular body) and an outer surface of the main tube 50. The gap functions as a transmission suppressing portion which suppresses transmission of vibrations of the engine 10 to the connecting pipe 38. A size of the gap (Φ2−Φ1) which functions as the transmission suppressing portion may be properly and freely set according to an amount of vibrations of the engine 10, strength of the connecting pipe 38 or the like. In general, it is sufficient to set the size of the gap to approximately 0.5% to 2% of the outer diameter Φ1 of the main tube 50.

As described previously, the center hole 68 is formed at the center of the second clamp piece 66, and the columnar portion 58 of the connecting pipe 38 is made to pass through the center hole 68. An inner diameter Φ4 of the center hole 68 (see FIG. 5) is also slightly larger than an outer diameter Φ3 of the columnar portion 58 (see FIG. 3), and the center hole 68 and the columnar portion 58 have a loose-fitting relationship. A size of the gap (Φ4−Φ3) between the center hole 68 and the columnar portion 58 may be set according to an amount of allowable movement of the connecting pipe 38 in the circumferential direction and in the axial direction with respect to the pipe-side connection portion 60.

That is, in this embodiment, the pipe-side connection portion 60 is formed of an annular body which is disposed on the outer periphery of the connecting pipe 38 with a gap, which functions as the transmission suppressing portion, provided therebetween. When such a configuration is adopted, the connecting pipe 38 is movable in the circumferential direction, in the radial direction, and in the axial direction of the connecting pipe 38 with respect to the pipe-side connection portion 60. As a result, vibrations in various directions resist being transmitted to the connecting pipe 38 so that it is possible to more reliably protect the connecting pipe 38 from the vibrations of the engine 10. However, when the sub tube 52 or the columnar portion 58 is not provided in such a configuration, the pipe-side connection portion 60 is movable in the circumferential direction and in the axial direction of the pipe-side connection portion 60 without any limitation. On the other hand, as in the case of this embodiment where the center hole 68 is formed in the pipe-side connection portion 60, and the columnar portion 58 which is made to pass through the center hole 68 is formed on the connecting pipe 38, due to the contact relationship between the columnar portion 58 and the center hole 68, an amount of movement of the connecting pipe 38 in the circumferential direction and in the axial direction with respect to the pipe-side connection portion 60 is limited to some extent. As a result, excessive movement of the connecting pipe 38 is restricted.

The engine-side connection portion 62 is coupled to an outer peripheral surface of the first clamp piece 64. A fitting portion 75 which is fitted in a fitting hole 45 of the bracket 44 (see FIG. 6) is formed at an end portion of the engine-side connection portion 62. The fitting portion 75 is a protrusion having a substantially rectangular shape in cross section. A fitting claw 76 is formed on an outer surface of the fitting portion 75. The fitting claw 76 has a tapered shape which projects further outward as a distance from a distal end of the fitting portion 75 increases. When the fitting portion 75 is inserted into the fitting hole 45 of the bracket, the fitting claw 76 bites into a peripheral edge of the fitting hole 45 so that the fitting portion 75 is firmly fitted in the fitting hole 45. When the fitting portion 75 is fitted in the fitting hole 45, the clamp 42 is firmly connected to the bracket 44 so that the relative movement between the clamp 42 and the bracket 44 is substantially eliminated. Accordingly, when the bracket 44 vibrates, the clamp 42 also vibrates. The bracket 44 is a sheet metal member which is directly or indirectly fastened to the engine 10. The bracket 44 is fastened to the engine 10 in a substantially stationary state with respect to the engine 10. Accordingly, when the engine 10 vibrates, the bracket 44 and therefore the clamp 42 also vibrate.

To be precise, it is difficult to completely integrally connect the bracket 44 and the clamp 42 to each other, so slight relative movement is also generated between both members 42, 44. Also in such a case, it is sufficient that an allowable displacement amount of the connecting pipe 38 with respect to the engine-side connection portion 62 be larger than an allowable displacement amount of the bracket 44 with respect to the engine-side connection portion 62.

The description is given with respect to advantageous effects obtained by fixing the connecting pipe 38 to the engine 10 by means of the clamp 42 and the bracket 44 having the above-mentioned configuration. In this case, the inlet hose 30 is fixed at an intermediate portion (connecting pipe 38) which is separated at a distance from the fixed end and hence, it is possible to prevent the inlet hose 30 from swinging significantly at the intermediate portion. Further, the gap, which functions as the transmission suppressing portion which suppresses transmission of vibrations, is present between the connecting pipe 38 and the clamp 42. Accordingly, even when the clamp 42 vibrates with the drive of the engine 10, the vibrations resist being transmitted to the connecting pipe 38. As a result, it is possible to avoid problems including a problem that the coupling between the connecting pipe 38 and the hoses 35, 36, 34 is loosened due to vibrations and a problem that the connecting pipe 38 receives stress, thus deteriorating or being damaged. That is, according to the structure disclosed in this specification, it is possible to prevent problems of the connecting pipe 38 caused by vibrations while the intermediate portion of the inlet hose 30 is appropriately fixed.

The configuration which has been described heretofore is merely for the sake of example. Other configurations may be changed where appropriate provided that a transmission suppressing portion which suppresses transmission of vibrations is provided between the engine-side connection portion 62 and the connecting pipe 38.

For example, in the description made heretofore, the transmission suppressing portion is formed of a gap between the connecting pipe 38 and the pipe-side connection portion 60. However, a buffer member which functions as the transmission suppressing portion may be provided between the connecting pipe 38 and the pipe-side connection portion 60 instead of the gap. It is desirable that the buffer member be made of a soft material having low repulsion which allows the displacement of the connecting pipe 38 with respect to the clamp 42 (pipe-side connection portion 60). For example, a rubber-based foam material such as EPT-sealer (R) or a rubber-based material such as EPDM may be used. Accordingly, for example, it may be configured such that such buffer members are provided on inner surfaces of the first clamp piece 64 and the second clamp piece 66, and the buffer members and the connecting pipe 38 come into close contact with each other. In this case, even when the clamp 42 vibrates with vibrations of the engine 10, the vibrations are absorbed by the buffer members, and the movement of the connecting pipe 38 with respect to the clamp 42 is allowed. As a result, vibrations of the engine 10 resist being transmitted to the connecting pipe 38 so that problems of the connecting pipe 38 caused by vibrations can be prevented.

In the description made heretofore, the transmission suppressing portion is provided between the pipe-side connection portion 60 and the connecting pipe 38. However, the transmission suppressing portion may be disposed at another portion provided that the portion is positioned between the engine-side connection portion 62 and the connecting pipe 38. For example, when the pipe-side connection portion 60 and the engine-side connection portion 62 are formed of separate components which are connected to each other with the transmission suppressing portion (gap, for example) interposed therebetween, the pipe-side connection portion 60 and the connecting pipe 38 may have a stationary relationship. Even when such a configuration is adopted, vibrations of the engine 10 resist being transmitted to the connecting pipe 38 and hence, problems of the connecting pipe 38 caused by the vibrations can be effectively prevented.

Further, in the description made heretofore, the connecting pipe 38 has the three-way configuration. However, the connecting pipe 38 does not necessarily have the three-way configuration provided that the connecting pipe 38 is formed of a pipe which connects two or more hoses (upstream hose 35, downstream hose 36) which form the radiator hose (inlet hose 30). Accordingly, the connecting pipe 38 may be formed of a straight pipe having no branch (a pipe having only the main tube 50 without having the sub tube 52), or may be formed of a pipe which branches into four or more directions. Further, the connecting pipe 38 (the pipe which is fixed to the engine 10) may be provided on an intermediate portion of the outlet hose 32 instead of the intermediate portion of the inlet hose 30. The connecting pipe 38 which is fixed to the engine 10 may be provided on each of the inlet hose 30 and the outlet hose 32.

REFERENCE SIGNS LIST

10 engine, 12 radiator, 14 motor unit, 16 power control unit, 18 radiator core, 20 radiator fan, 22 introduction port, 24 discharge port, 26 inlet pipe, 28 outlet pipe, 30 inlet hose (radiator hose), 32 outlet hose (radiator hose), 34 cooler hose, 35 upstream hose, 36 downstream hose, 38 connecting pipe, 40 quick joint, 42 clamp, 44 bracket, 50 main tube, 52 sub tube, 54 protruding portion, 56 annular rib, 58 columnar portion, 60 pipe-side connection portion, 62 engine-side connection portion, 64 first clamp piece, 66 second clamp piece, 68 center hole, 70 hinge portion, 72 engaging pin, 74 engaging hole, 76 fitting claw, 80 hose band, 100 engine compartment.

The invention claimed is:

1. An engine cooling structure where an engine is cooled by a cooling fluid supplied from a radiator, and the cooling fluid discharged from the engine is cooled by the radiator, the engine cooling structure comprising:

a radiator hose having one end coupled to the engine, and having the other end coupled to the radiator, the radiator hose including two or more hose members and a connecting pipe configured to connect the two or more hose members to each other; and a clamp including a pipe-side connection portion connected to the connecting pipe, and an engine-side connection portion fixed to the engine, wherein a transmission suppressing portion configured to suppress transmission of vibrations from the engine-side connection portion to the connecting pipe is provided between the engine-side connection portion and the connecting pipe, the pipe-side connection portion includes an annular body disposed on an outer periphery of the connecting pipe with a gap which functions as the transmission suppressing portion, the gap extending continuously from the outer periphery of the connecting pipe to an inner periphery of the pipe-side connection portion along a radial direction of the connecting pipe such that the gap allows the connecting pipe to move relative to the pipe-side connection portion, and the radiator hose is not disposed between the pipe-side connection portion and the connecting pipe along the radial direction of the connecting pipe.

2. The engine cooling structure according to claim 1, wherein the connecting pipe includes a main tube, and a columnar portion which stands out from a peripheral surface of the main tube, and the pipe-side connection portion has: the annular body disposed on the outer periphery of the main tube with the gap, which functions as the transmission suppressing portion, interposed between the annular body and the outer periphery of the main tube; and a center hole which is formed in a peripheral surface of the annular body, and into which the columnar portion is inserted.

* * * * *